United States Patent [19]

Soga et al.

[11] Patent Number: 4,875,426

[45] Date of Patent: Oct. 24, 1989

[54] FLOAT ATTACHMENT FOR WATERCRAFTS

[75] Inventors: Katumasa Soga, Kobe; Kazuo Matsutani, Akashi, both of Japan

[73] Assignee: Kawasaki Jukogyo Kobushiki Kaisha, Japan

[21] Appl. No.: 143,113

[22] Filed: Jan. 12, 1988

[30] Foreign Application Priority Data

Jan. 16, 1987 [JP] Japan ..... 62-4480[U]

[51] Int. Cl.[4] ..... B63B 43/14

[52] U.S. Cl. ..... 114/123; 114/61; 114/270

[58] Field of Search ..... 114/61, 123, 357, 347, 114/364, 283, 270

[56] References Cited

U.S. PATENT DOCUMENTS

| | | | |
|---|---|---|---|
| D. 265,820 | 8/1982 | Tomonaga | D12/307 |
| 3,703,877 | 11/1972 | Ueda | 114/270 |
| 3,792,676 | 2/1974 | Craft | 114/123 |
| 4,320,713 | 3/1982 | Nishida et al. | 114/123 |
| 4,512,277 | 4/1985 | Williams | 114/123 |
| 4,664,054 | 5/1987 | Nishida | 114/270 |

FOREIGN PATENT DOCUMENTS

| | | | |
|---|---|---|---|
| WO85/01486 | 4/1985 | PCT Int'l Appl. | 114/123 |

*Primary Examiner*—Joseph F. Peters, Jr.
*Assistant Examiner*—Jesû D. Sotelo
*Attorney, Agent, or Firm*—Leydig, Voit & Mayer

[57] ABSTRACT

A float attachment for a small-sized watercraft having a deck and a hull, which comprises flange portions positioned at a junction between the deck and the hull, a clamp for clamping the flange portions and a float attached to the clamp, which can be removably mounted on the watercraft by means of the clamp.

2 Claims, 2 Drawing Sheets

FLOAT ATTACHMENT FOR WATERCRAFTS

BACKGROUND OF THE INVENTION

The present invention relates to a float for a small-sized watercraft, and more particularly, it relates to a float attachment for removably mounting a float on a small-sized watercraft.

Some small-sized watercraft have been mainly used in water sports or for leisure purposes, which is suited to running about the water areas near the shore, under the control of a rider on a rear deck of the craft who manipulates a bar handle projecting upwardly from the bow portion of the shell of the craft.

Such a small-sized watercraft runs at a high speed (for example, at a speed of 50 km/h) and has excellent mobility, and, in general, has an engine arranged in an engine room or compartment formed in the bow portion of the shell of the watercraft and a propulsion means arranged in the stern portion of the shell. The watercraft is so constructed that the propulsion means is driven by the engine and the craft is steered by changing the direction of a propellant force generated by the propulsion means.

The propulsion means may be, for example, a water jet system wherein the propellant force is obtained by jetting rearwardly the water sucked from tee bottom of the craft by means of a jet pump. Normally, such water jet system can control the steering of the craft by changing orientation of a duct from which a water jet is ejected.

The propulsion means is mounted in a recess which is formed in the stern bottom portion of the watercraft and is opened downwardly, the lower opening of the recess being closed by a cover which constitutes a part of the bottom of the watercraft.

In the small-sized watercraft having the above-mentioned construction, the buoyancy of the watercraft when anchored is so selected that the craft is floating on the water in its vacant condition but may be nearly sunk when a rider get it on. Since the buoyancy of the watercraft is very small as stated above, it is very difficult for a beginner to get on the deck of the watercraft in the water.

In this connection, it has been proposed to provide float attachments for removably mounting a float on the watercraft so that the beginner could easily get on the craft placed in the water. An example of such float attachment is disclosed in WO 85/01486 (PCT/US 84/01221).

Such a conventional float attachment is so constructed that U-shaped floats are inserted from the bow and the stern onto guides consisting of flange portions, formed at junctions (on the sides of the craft) between a deck and a hull.

However, in the above conventional float attachment, there arise problems that the float itself is large or huge, and that clouds of spray are generated by striking water against the float during the running of the craft and the float situated on one side of the craft is immersed further into the water during the cornering of the craft with the result that water resistance increases to decelerate the watercraft.

SUMMARY OF THE INVENTION

An object of the present invention is to provide an improved float attachment for a small-sized watercraft which can solve the above problems and which has a simple construction and can be easily mounted on the watercraft and which does not generate water resistance during the running of the craft.

According to the present invention, in order to achieve the above object, there is provided a float attachment for a small-sized watercraft having a deck, a hull including sides of the watercraft and a bar handle which comprises flange portions formed at a junction between the deck and the hull, at least one clamp for clamping the flange portions, and at least one float attached to the clamp in such a manner that when the float is mounted on the watercraft by the clamp the whole float is positioned above the water level during the running of the watercraft.

Preferably, the float is attached to the clamp in such a manner that when the float is mounted on the watercraft the float protrudes outwardly of the side of the hull.

DESCRIPTION OF PREFERRED EMBODIMENTS

The present invention will now be explained with reference to the attached drawings in more detail.

Figure 2:
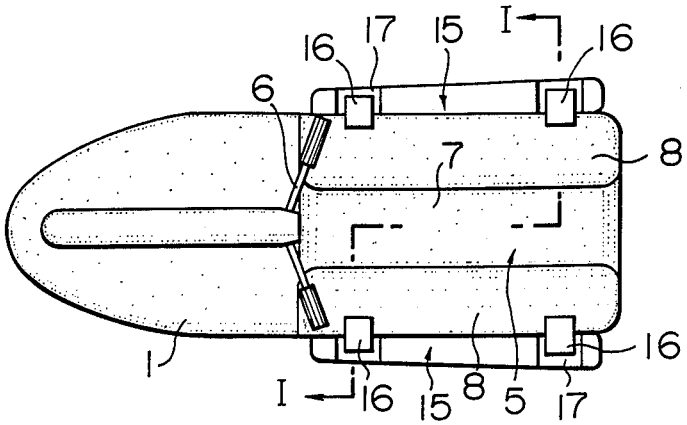
FIG. 2 is a plan view showing a watercraft on which the float attachment is mounted.
Figure 3:
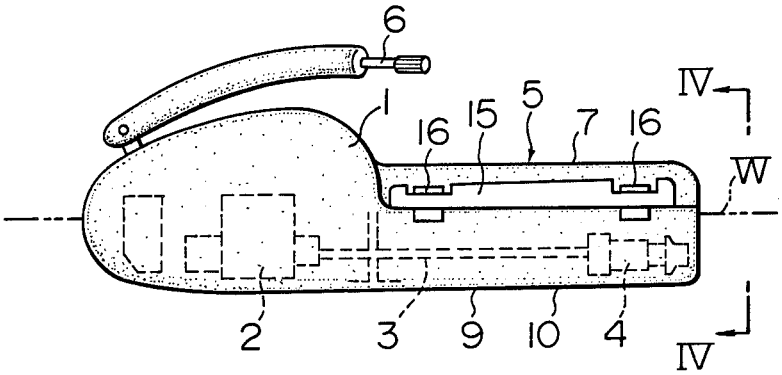
FIG. 3 is a light side view of the watercraft of FIG. 2.
Figure 4:
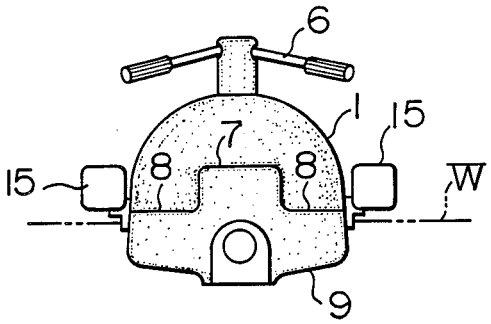
FIG. 4 is a rear end view looking at along the line IV—IV of FIG. 3.

FIG. 2 shows a plan view of a small-sized watercraft on which a float according to the present invention is mounted, FIG. 3 shows a light side view of the watercraft of FIG. 2, and FIG. 4 shows a rear end view looking at along the line IV—IV of FIG. 3.

Referring to FIGS. 2 to 4, a small-sized watercraft comprises a shell in the front portion of which is formed an engine room or housing 1 which accomodates an engine 2 (FIG. 3). A propulsion means 4 (FIG. 3) arranged on the stern portion of the shell is driven by the engine 2 through a driving shaft 3 (FIG. 3). The propulsion means 4 may comprise a jet pump.

A rear deck 5 positioned rearwardly of the engine room 1 provides a seat for a rider. The rider can control the watercraft by grasping a steering bar handle device 6 (more particularly, grip portions on both ends thereof) positioned on a bow portion of the watercraft.

In the illustrated embodiment, the rear deck 5 has a central protrusion which constitutes an upwardly projecting saddle-shaped seat portion 7, with step portions 8, 8 formed on both sides of the seat portion.

In FIGS. 3 and 4, two-dot-and-dash line W represents the water level.

The rider usually gets on the watercraft in standing posture on the side steps 8, 8 or in riding posture on the central seat portion 7.

The propulsion means is constructed so that the water sucked from an intake port formed on a bottom of the watercraft by means of the jet pump 4 driven by the engine 2 is jetted rearwardly from the stern portion of the watercraft to obtain a propellant force of the craft.

Figure 1:
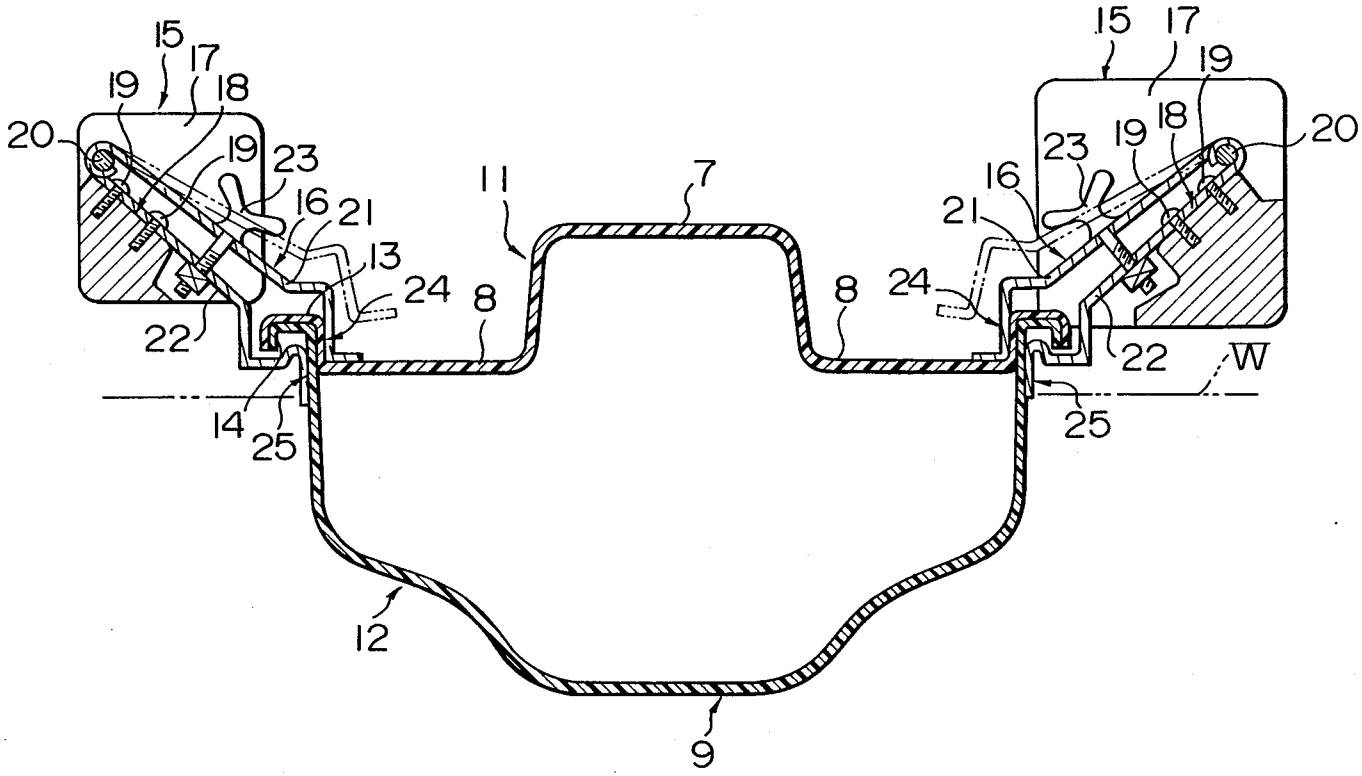
FIG. 1 is a cross-sectional view of a float attachment mounted on a small-sized watercraft according to a preferred embodiment of the present invention, taken along the line I—I of FIG. 2.

FIG. 1 is a sectional view taken along the line I—I of FIG. 2, showing a main portion of the present invention. Referring to FIG. 1, the shell of the watercraft is constituted by a hollow body obtained by interconnecting a deck 11 and a hull 12 by means of respective peripheral flange portions 13 and 14. The deck 11 and hull 12 are normally made of plastic material (including fiber reinforced plastic material).

Floats 15, 15 (FIGS. 1 to 4) are removably mounted on both (right and left) flange portions 13 and 14 which constitute junctions between the deck 11 and the hull 12. More particularly, each of the floats 15, 15 is provided at its front and rear portions with clamps 16, 16 (FIGS. 1 to 3) by which the corresponding float 15 is removably mounted on the shell in such a manner that the clamps 16 clamp the flange portions 13, 14 as shown by a solid line in FIG. 1.

As shown in FIG. 1, each clamp 16 is attached, by means of bolts 19, 19, to a flat portion 18 in a recess 17 (FIGS. 1 and 2) formed in the float 15. Further, as shown in FIG. 1, each clamp 16 comprises a pair of clamp arms 21 and 22 which are rockably connected by means of a hinge 20, and a bolt-nut means 23 for closing or approaching the clamp arms 21 and 22 toward each other. Free end portions (clamp portions) of the clamp arms 21 and 22 are so shaped that when the clamp 16 clamps the flange portions 13 and 14 the clamp portions are pressed against predetermined surfaces of the flanges 13 and 14 (for example, in the illustrated embodiment, an inner vertical surface 24 of the inner end of the flange 13 and an outer vertical surface 25 of the inner end of the flange 14).

In the illustrated embodiment, each float 15 has a tapered configuration so that the cross-section of the float decreases gradually from the rear end thereof to the front end thereof. For example, the float comprises an elongated body having a length of 1400 mm, a maximum cross-section (i.e., cross-section in the rear end thereof) of 230 mm × 16 mm and a minimum cross-section of about half the value of the maximum cross-section.

Preferably, the bolt-nut means 23 for closing the clamp arms 21, 22 comprises a butterfly bolt and a corresponding nut so as to eliminate the use of any tools.

As stated above, each float 15 is mounted on the shell of the watercraft by means of the corresponding clamps 16 in such a manner that the clamp arms 21 and 22 are pressed against both surfaces of the flanges 13 and 14 at the junction between the deck 11 and the hull 12. Further, the float 15 is mounted on the watercraft on a relatively higher level so that when the watercraft is running on the water the whole float is positioned above the water level W.

In use, the clamps 16, 16 are previously attached to each float 15; the bolt-nut means 23 is released enough to open or separate the clamp arms 21 and 22 as shown by a phantom line in FIG. 1; then, the clamp portions of the clamp arms 21, 22 are positioned around the flange portions 13 and 14 of the shell; and lastly, the bolt-nut means 23 is tightened to press the clamp portions against the flange surfaces 24 and 25, thereby mounting the float on the shell. Reverse operations will be available to dismount the float from the shell. The mounting and/or dismounting operations can be effected under water.

According to the embodiment described above, since removable floats 15, 15 are prepared for the watercraft, even when buoyancy of the watercraft when anchored is selected to a relatively low value to improve the running efficiency of the watercraft, the buoyancy can be increased by merely mounting the floats on the watercraft without modifying the craft itself, thereby providing a small-sized watercraft wherein any beginner can easily get on the craft even on the water and can easily begin to start the craft.

In this case, since the floats are mounted on the watercraft on the higher level so that when the craft is running on the water the whole floats are positioned above the water level, clouds of spray and water impact due to the presence of the floats can be considerably decreased and the whole float cannot be sunk under water completely during the cornering of the craft, thereby eliminating or decreasing water resistance due to the provision of the floats when the craft is running on the water.

Further, since the floats are mounted on only a part of the sides of the watercraft, unlike the conventional construction wherein floats are mounted on the whole sides of the craft, the floats can be compact, easy to transport and easy to mount and/or dismount.

Although a single float 15 is mounted on each side of the craft in the illustrated embodiment, two or more floats can be mounted on each side of the watercraft.

Further, although, in the illustrated embodiment, the present invention is applied to the shell wherein the rear deck 5 has the central protrusion for the saddle-shaped seat portion 7, the present invention is similarly applicable to the shell wherein the rear deck is provided, on its both sides, with upwardly projecting fins between which is formed a riding floor, or the rear deck has a flat rider's seat.

As apparent from the foregoing explanation, according to the present invention, since the floats are mounted on the watercraft on the higher level so that when the craft is running on the water the whole floats are positioned above the water level, by means of the clamping means for clamping the floats on the flange surfaces of the flanges situated at the junction between the deck and the hull, there can be provided a float for a watercraft which has a simple construction and is easy to mount and/or dismount and does not generate water resistance during the running of the craft.

What is claimed is:

1. A float attachment for a small-sized watercraft having a deck, a hull including sides of the watercraft, and a bar handle, comprising:

flange portions formed at a junction between said deck and said hull;

at least one clamp comprising a hinge, a pair of clamp arms rockably connected to each other by said hinge, and means for closing said clamp arms; and at least one float attached to said at least one clamp in such a manner that when the float is mounted on the watercraft by said at least one clamp the float provides buoyant support when the watercraft is mounted by a rider but the whole float is positioned above the water level during running of the watercraft without change in the relative positions of the watercraft and the float.

2. A float attachment as defined in claim 1, wherein said means for closing the clamp arms includes a bolt and a nut.

* * * * *

UNITED STATES PATENT AND TRADEMARK OFFICE

CERTIFICATE OF CORRECTION

PATENT NO. : 4,875,426

DATED : October 24, 1989

INVENTOR(S) : Soga et al.

It is certified that error appears in the above-identified patent and that said Letters Patent is hereby corrected as shown below:

On the title page, the assignment data should read:
--[73] Assignee: Kawasaki Jukogyo Kabushiki Kaisha, Japan--.

Signed and Sealed this

Nineteenth Day of February, 1991

*Attest:*

HARRY F. MANBECK, JR.

*Attesting Officer*

*Commissioner of Patents and Trademarks*